US010923258B2

(12) United States Patent
Moro et al.

(10) Patent No.: US 10,923,258 B2
(45) Date of Patent: Feb. 16, 2021

(54) DUST CORE AND INDUCTOR ELEMENT

(71) Applicant: TDK CORPORATION, Tokyo (JP)

(72) Inventors: Hideharu Moro, Tokyo (JP); Akihiro Harada, Tokyo (JP); Yu Yonezawa, Tokyo (JP)

(73) Assignee: TDK CORPORATION, Tokyo (JP)

( * ) Notice: Subject to any disclaimer, the term of this patent is extended or adjusted under 35 U.S.C. 154(b) by 240 days.

(21) Appl. No.: 16/197,996

(22) Filed: Nov. 21, 2018

(65) Prior Publication Data

US 2019/0189319 A1 Jun. 20, 2019

(30) Foreign Application Priority Data

Dec. 14, 2017 (JP) ..... JP2017-239313

(51) Int. Cl.

| | |
|---|---|
| ***H01F 1/24*** | (2006.01) |
| ***B22F 1/00*** | (2006.01) |
| ***H01F 27/255*** | (2006.01) |
| ***H01F 3/08*** | (2006.01) |
| *C22C 33/02* | (2006.01) |

(52) U.S. Cl.

CPC ..... *H01F 1/24* (2013.01); *B22F 1/0014* (2013.01); *H01F 3/08* (2013.01); *H01F 27/255* (2013.01); *B22F 2301/15* (2013.01); *B22F 2301/20* (2013.01); *B22F 2301/35* (2013.01); *B22F 2304/10* (2013.01); *C22C 33/02* (2013.01); *C22C 2202/02* (2013.01)

(58) Field of Classification Search

None

See application file for complete search history.

(56) References Cited

U.S. PATENT DOCUMENTS

| | | | | |
|---|---|---|---|---|
| 2013/0228716 | A1 | 9/2013 | Suetsuna et al. | |
| 2014/0319406 | A1 | 10/2014 | Suetsuna et al. | |
| 2016/0303651 | A1* | 10/2016 | Mio | H01F 1/06 |
| 2017/0154720 | A1* | 6/2017 | Ohkubo | H01F 27/42 |

FOREIGN PATENT DOCUMENTS

| | | | |
|---|---|---|---|
| JP | 2009-206337 | A | 9/2009 |
| JP | 2012-222062 | A | 11/2012 |
| JP | 2016-012715 | A | 1/2016 |
| JP | 2017-120924 | A1 | 7/2017 |

* cited by examiner

*Primary Examiner* — George Wyszomierski
(74) *Attorney, Agent, or Firm* — Oliff PLC

(57) ABSTRACT

A dust core excellent in DC superimposition characteristics and low in eddy current loss at a high frequency band of several MHz, and an inductor element using the dust core. A dust core contains large and small particles of insulated soft magnetic material powder, wherein the large and small particles have a saturation magnetic flux density of 1.4 T or more, and wherein in the soft magnetic material powder observed in a cross section of the dust core, a ratio of an area occupied by large particles to an area occupied by small particles in the cross section is 9:1 to 5:5, when a group of particles having particle size of 3 μm or more and 15 μm or less is defined as the large particles, and group of particles having a particle size of 300 nm or more and 900 nm or less is defined as the small particles.

8 Claims, No Drawings

DUST CORE AND INDUCTOR ELEMENT

BACKGROUND OF THE INVENTION

The present invention relates to a dust core and an inductor element using the same.

In recent years, higher frequency of a power supply is progressing, and an inductor element suitable for use in a high frequency band of several MHz is required. In addition, an inductor element using a material excellent in DC superimposition characteristics for miniaturization and low in eddy current loss (core loss) for increasing the efficiency of the power supply is required.

JP-A-2016-12715 discloses an inductor element capable of being used at a high frequency band. However, for miniaturization, the permeability is low, the DC superimposition characteristics are also insufficient, and the core loss is large.

JP-A-2017-120924 also discloses an inductor element capable of being used at a high frequency band, but having low permeability. In addition, DC superimposition characteristics and core loss are not disclosed. Therefore, no knowledge about miniaturization and efficiency improvement of the power supply can be obtained.

[Patent Document 1] JP-A-2016-12715

[Patent Document 2] JP-A-2017-120924

BRIEF SUMMARY OF THE INVENTION

An object of the present invention is to provide a dust core excellent in DC superimposition characteristics and low in eddy current loss at a high frequency band of several MHz, and an inductor element using the dust core.

The present inventors have found that the DC superimposition characteristics are excellent and the eddy current loss is reduced at a high frequency band of several MHz, by making a dust core containing large particles and small particles of soft magnetic material powder having a saturation magnetic flux density equal to or higher than a predetermined value at a predetermined ratio.

The summary of the present invention is as follows.

(1) A dust core containing large particles and small particles of insulated soft magnetic material powder, wherein the large particles and the small particles have a saturation magnetic flux density of 1.4 T or more, and wherein in the soft magnetic material powder observed in a cross section of the dust core, a ratio of an area occupied by the large particles to an area occupied by the small particles in the cross section is 9:1 to 5:5, when a group of particles having an average particle size of 3 μm or more and 15 μm or less is defined as the large particles, and a group of particles having an average particle size of 300 nm or more and 900 nm or less is defined as the small particles.

(2) The dust core according to (1), wherein the small particles have an electrical resistance of 40 μΩ·cm or more.

(3) The dust core according to (1) or (2), wherein the small particles are alloy powder containing at least Fe and Si.

(4) The dust core according to (3), wherein the small particles contain one or more elements selected from the group consisting of Ni, Co, and Cr.

(5) An inductor element containing the dust core according to any one of (1) to (4).

(6) A dust core containing large particles and small particles of insulated soft magnetic material powder, wherein the large particles and the small particles have a saturation magnetic flux density of 1.4 T or more, wherein in the soft magnetic material powder observed in a cross section of the dust core, a ratio of an area occupied by the large particles to an area occupied by the small particles in the cross section is 9:1 to 5:5, when a group of particles having a particle size of 3 μm or more and 15 μm or less is defined as the large particles, and a group of particles having a particle size of 300 nm or more and 900 nm or less is defined as the small particles, wherein the small particles are alloy powder containing at least Fe and Si, and wherein the small particles have an electrical resistance of 40 μΩ·cm or more.

(7) The dust core according to (6), wherein the small particles contain one or more elements selected from the group consisting of Ni, Co, and Cr.

(8) The dust core according to (6) or (7), wherein the small particles are comprised of any one of an Fe—Si alloy, an Fe—Si—Cr alloy, and an Fe—Ni—Si—Co alloy.

(9) An inductor element containing the dust core according to any one of (6) to (8).

According to the present invention, a dust core excellent in DC superimposition characteristics and low in eddy current loss at a high frequency band of several MHz, and an inductor element using the dust core can be provided.

DETAILED DESCRIPTION OF INVENTION

Hereinafter, the present invention will be described based on specific embodiments, but various modifications are allowed without departing from the gist of the present invention.

(Dust Core)

Soft magnetic material powder constituting a dust core according to the present embodiment contains large particles and small particles.

Such a dust core is suitably used as a magnetic core of a coil-type electronic component such as an inductor element. For example, the coil-type electronic component may be a coil-type electronic component in which an air-core coil wound with a wire is buried in a dust core having a predetermined shape, or a coil-type electronic component in which a predetermined number of turns of wires are wound on a surface of a dust core having a predetermined shape. Examples of the shape of the magnetic core around which the wire is wound can include an FT shape, an ET shape, an EI shape, a UU shape, an EE shape, an EER shape, a UI shape, a drum shape, a toroidal shape, a pot shape, a cup shape or the like.

(Soft Magnetic Material Powder)

In the soft magnetic material powder constituting the dust core according to the present embodiment, the large particles and the small particles have a saturation magnetic flux density of 1.4 T or more, more preferably 1.6 T or more, and still more preferably 1.7 T or more. An upper limit of the saturation magnetic flux density is not particularly limited. When the saturation magnetic flux density is within the above range, the miniaturization of the inductor element can be realized. The saturation magnetic flux density may be the same value or may be different values for the large particles and the small particles.

In the soft magnetic material powder observed in a cross section of the dust core according to the present embodiment, when a group of particles having a particle size of 3 μm or more and 15 μm or less is defined as the large particles, and a group of particles having a particle size of 300 nm or more and 900 nm or less is defined as the small particles, a ratio [large particles:small particles] of an area occupied by the large particles to an area occupied by the small particles in the cross section is 9:1 to 5:5, preferably 8.5:1.5 to 6.0:4.0, and more preferably 8.0:2.0 to 6.5:3.5. When the ratio of the area occupied by the large particles to the area occupied by the small particles is within the above range, a dust core excellent in DC superimposition characteristics can be obtained.

The cross section of the dust core can be observed with an SEM image. Then, a circle equivalent diameter is calculated for the soft magnetic material powder observed in the image of the cross section, and is taken as the particle size. At this time, the particle size does not include a thickness of an insulating layer to be described later. In the present embodiment, since the soft magnetic material powder contains the large particles and the small particles, particles having a large particle size and particles having a small particle size are observed as the soft magnetic material powder in the cross section of the dust core. Particularly, in the present embodiment, in the cross section of the dust core, particles having a particle size of 3 μm or more and 15 μm or less are observed as the particles having a large particle size (large particles), and particles having a particle size of 300 nm or more and 900 nm or less are observed as the particles having a small particle size (small particles). Further, in the present embodiment, when the ratio of the area occupied by the large particles to the area occupied by the small particles in the cross section of the dust core is within the above range, a dust core excellent in DC superimposition characteristics and low in eddy current loss can be obtained.

In the present embodiment, the ratio of the area occupied by the large particles to the area occupied by the small particles in the cross section of the dust core is approximately equal to a weight ratio of the large particles to the small particles contained in the dust core. Therefore, in the present embodiment, the weight ratio of the large particles to the small particles contained in the dust core can be treated as the ratio of the area occupied by the large particles to the area occupied by the small particles in the cross section of the dust core.

In the soft magnetic material powder constituting the dust core according to the present embodiment, the weight ratio of the large particles to the small particles is preferably 9:1 to 5:5, more preferably 8.5:1.5 to 6.0:4.0, and still more preferably 8.0:2.0 to 6.5:3.5.

In the present embodiment, the small particles preferably have an electrical resistance of 40 μΩ·cm or more, more preferably 60 μΩ·cm or more, and still more preferably 70 μΩ·cm or more. In addition, an upper limit of the electrical resistance of the small particles is not particularly limited. When the electrical resistance of the small particles is within the above range, the eddy current loss (core loss) can be reduced at the high frequency band. The electrical resistance of the small particles can be controlled by adjusting the composition of the small particles.

In the present embodiment, the small particles preferably contain Fe, and more preferably the small particles are alloy powder containing at least Fe and Si. In addition, the small particles may further contain one or more elements selected from the group consisting of Ni, Co, and Cr. Therefore, as the small particles, for example, pure iron, an Fe—Si alloy, an Fe—Si—Cr alloy, and an Fe—Ni—Si—Co alloy can be used. In addition, the small particles may be any one of an Fe—Si alloy, an Fe—Si—Cr alloy, and an Fe—Ni—Si—Co alloy. When the small particles contain the above elements, a dust core excellent in DC superimposition characteristics can be obtained.

In addition, in the present embodiment, the large particles are alloy powder preferably containing at least Fe and Si. In addition, the large particles may further contain one or more elements selected from the group consisting of Ni, Co, and Cr. Therefore, as the large particles, for example, an Fe—Si alloy, an Fe—Si—Cr alloy, and an Fe—Ni—Si—Co alloy can be used. When the large particles contain the above elements, a dust core excellent in DC superimposition characteristics can be obtained.

In the present embodiment, the large particles and the small particles may have the same composition or different compositions.

A method for manufacturing the large particles is not particularly limited. For example, the large particles are manufactured by various powdering methods such as atomization methods (for example, a water-atomization method, a gas-atomization method, and a high-speed rotating water flow atomization method), a reduction method, a carbonyl method, and a pulverization method. The water-atomization method is preferred.

In addition, a method for manufacturing the small particles is not particularly limited. For example, the small particles are manufactured by various powdering methods such as a pulverization method, a liquid phase method, a spray pyrolysis method and a melt method.

In the present embodiment, an average particle size of the large particles is preferably 3 μm to 15 μm, and more preferably 3 μm to 10 μm. In addition, an average particle size of the small particles is preferably 300 nm to 900 nm, and more preferably 500 nm to 800 nm. When the soft magnetic material powder contains the large particles and the small particles having different particle sizes, a density of the soft magnetic material powder in the dust core increases and the permeability increases, so that the DC superimposition characteristics are improved and the eddy current loss (core loss) can be reduced.

In the present embodiment, the large particles and the small particles are insulated. Examples of an insulation method include a method of forming an insulating layer on the particle surface, and a method of oxidizing the particle surface by heat treatment. In a case of forming an insulating layer, examples of a constituent material of the insulating layer include a resin or an inorganic material. Examples of the resin include a silicone resin and an epoxy resin. Examples of the inorganic material include: phosphates such as magnesium phosphate, calcium phosphate, zinc phosphate, manganese phosphate, cadmium phosphate; silicates such as sodium silicate (water glass); soda lime glass; borosilicate glass; lead glass; aluminosilicate glass; borate glass; and sulfate glass. When an insulating layer is formed on surfaces of the large particles and the small particles, the insulating property of each particle can be enhanced.

The insulating layer on the large particles preferably have a thickness of 10 nm to 400 nm, more preferably 20 nm to 200 nm, and still more preferably 30 nm to 150 nm. In addition, the insulating layer on the small particles preferably have a thickness of 3 nm to 30 nm, more preferably 5 nm to 20 nm, and still more preferably 5 nm to 10 nm. When the thickness of the insulating layer is excessively small, sufficient corrosion resistance cannot be obtained and voltage resistance of the inductor may decrease. When the thickness of the insulating layer is excessively large, a space between the magnetic particles becomes wide, and the permeability μ may decrease when soft magnetic material powder is made into a dust core. The insulating layer may cover the entire surfaces of the large particles and the small particles, or may cover only a part of the surface.

(Binding Material)

The dust core can contain a binding material. The binding material is not particularly limited, and examples thereof include various organic polymer resins, silicone resins, phenol resins, epoxy resins, and water glass. A content of the binding material is not particularly limited. For example, when the entire dust core is 100 mass %, the content of the soft magnetic material powder can be 90 mass % to 98 mass % and the content of the binding material can be 2 mass % to 10 mass %.

(Method for Manufacturing Dust Core)

A method for manufacturing the dust core is not particularly limited, and a known method can be adopted. Examples include the following method. First, the insulated soft magnetic material powder and the binding material are mixed to obtain mixed powder. If necessary, the obtained mixed powder may be used as granulated powder. Then, the mixed powder or granulated powder is filled in a mold and compression-molded to obtain a molded body having a shape of a magnetic material (dust core) to be produced. The obtained molded body is subject to heat treatment, so as to obtain a dust core having a predetermined shape to which the soft magnetic powder is fixed. A condition of the heat treatment is not particularly limited. For example, the heat treatment temperature can be 150° C. to 220° C. and the heat treatment time can be 1 hour to 10 hours. In addition, an atmosphere during the heat treatment is also not particularly limited. For example, the heat treatment can be performed in an air atmosphere or an inert gas atmosphere such as argon or nitrogen. A wire is wound a predetermined number of times on the obtained dust core, so as to obtain an inductor element.

The mixed powder or granulated powder and an air-core coil formed by winding the wire a predetermined number of times may be filled in a mold and compression-molded to obtain a molded body embedded with the coil. The obtained molded body is subject to heat treatment, so as to obtain a dust core having a predetermined shape embedded with the coil. Since such a dust core has a coil embedded therein, the dust core functions as an inductor element.

Although the embodiment of the present invention has been described above, the present invention is not limited to the above embodiment at all and modifications may be made in various modes within the scope of the present invention.

EXAMPLES

Hereinafter, the present invention will be described in more detail by way of examples, but the present invention is not limited to these examples.

The area ratio, the saturation magnetic flux density, the electrical resistance of the small particles, an initial permeability (μi), a DC permeability (μdc), the DC superimposition characteristics, and the core loss were measured as follows. The results are shown in Table 1.

<Area Ratio>

The dust core was fixed with a cold-mounting resin, and the cross section was cut out, mirror-polished, and observed with SEM. The circle equivalent diameter of the soft magnetic material powder in the SEM image was calculated and used as the particle size. Particles having a particle size in a range of 3 μm to 15 μm were taken as large particles and particles having a particle size in a range of 300 nm to 900 nm were taken as small particles. The ratio of the area occupied by the large particles to the area occupied by the small particles in the cross section of the dust core was determined.

<Saturation Magnetic Flux Density>

A vibrating sample magnetometer (VSM) (manufactured by Tamagawa CO., LTD) was used, the large particles or small particles were placed in a sample holder, these particles were immobilized with paraffin so as not to move during vibration, and the saturation magnetic flux density was measured at room temperature under an applied magnetic field of 8 kA/m.

<Electrical Resistance of Small Particles>

Since the electrical resistance depends on the composition, the electrical resistance of sample particles prepared to have the same composition as that of the small particles was measured and used as the electrical resistance of the small particles. That is, the sample particles having the same composition as the small particles and having a diameter of approximately 10 μm were fixed with a resin, the cross section was cut out, four measurement terminals made of tungsten were placed on the sample particles, a voltage was applied thereto, and a current at that time was measured to determine the electrical resistance.

<Initial Permeability (μi), DC Permeability (μdc), and DC Superimposition Characteristics>

Inductance of the dust core at a frequency of 3 MHz was measured by using an LCR meter (4284A manufactured by Agilent Technologies) and a DC bias power supply (42841A manufactured by Agilent Technologies), and the permeability of the dust core was calculated from the inductance. The inductance was measured in a case where a DC superimposed magnetic field was 0 A/m and a case where the DC superimposed magnetic field was 8,000 A/m, and the permeabilities of the cases were taken as μi (0 A/m) and μdc (8000 A/m), respectively. A value of μdc/μi was taken as the DC superimposition characteristics.

<Core Loss>

The core loss was measured by using a BH analyzer (SY-8258 manufactured by IWATSU ELECTRIC CO., LTD.) under conditions of frequencies of 3 MHz and 5 MHz and a measurement magnetic flux density of 10 mT.

Example 1

Large particles having a composition of $Fe_{6.5}Si$ and an average particle size of 3 μm were obtained by a water-atomization method. In addition, small particles having a composition of $Fe_{6.5}Si$ and an average particle size of 300 nm were obtained by a liquid phase method.

The large particles and the small particles were blended at a weight ratio of 7:3, and the blended particles were used as soft magnetic material powder.

An insulating layer having a thickness of 10 nm was formed using zinc phosphate on the soft magnetic material powder.

The blended particles were diluted and added with xylene such that the silicone resin was 3 mass % based on 100 mass % of the soft magnetic material powder formed with the insulating layer in total, kneaded with a kneader, and dried, and the obtained agglomerates were sized to have a size of 355 μm or less to obtain granules. The granules were filled in a toroidal mold having an outer diameter of 17.5 mm and an inner diameter of 11.0 mm and pressed at a molding pressure of 2 t/cm$^2$ to obtain a molded body. The core weight was 5 g. The obtained molded body was subject to heat treatment in a belt furnace at 750° C. for 30 minutes at a nitrogen atmosphere to obtain a dust core.

The dust core was fixed with a cold-mounting resin, and the cross section was cut out, mirror-polished, and observed with SEM. The circle equivalent diameter of the soft magnetic material powder in the SEM image was calculated and used as the particle size. When a group of particles having a particle size of 3 μm or more and 15 μm or less was defined as large particles, and a group of particles having a particle size of 300 nm or more and 900 nm or less was defined as small particles, the ratio of the area occupied by the large particles to the area occupied by the small particles in the cross section of the dust core was 7:3, which coincided with the weight ratio of the large particles to the small particles contained in the dust core. In the following examples, the ratio of the area occupied by the large particles to the area occupied by the small particles in the cross section of the obtained dust core also coincided with the weight ratio of the large particles to the small particles contained in the dust core.

Example 2

A dust core was obtained in the same manner as in Example 1 except that particles having an average particle size of 5 μm as large particles and particles having an average particle size of 450 nm as small particles were used.

Example 3

A dust core was obtained in the same manner as in Example 1 except that particles having an average particle size of 10 μm as large particles and particles having an average particle size of 700 nm as small particles were used.

Example 4

A dust core was obtained in the same manner as in Example 1 except that particles having an average particle size of 15 μm as large particles and particles having an average particle size of 900 nm as small particles were used.

Example 5

A dust core was obtained in the same manner as in Example 3 except that small particles having a composition of $Fe_4Si_2Cr$ were used.

Example 6

A dust core was obtained in the same manner as in Example 3 except that small particles having a composition of $FeNi_2Si_3Co$ were used.

Example 7

A dust core was obtained in the same manner as in Example 3 except that small particles having a composition of Fe were used.

Example 8

A dust core was obtained in the same manner as in Example 3 except that large particles having a composition of $Fe_{45}Si$ and small particles having a composition of $Fe_{45}Si$ were used.

Example 9

A dust core was obtained in the same manner as in Example 3 except that large particles having a composition of $Fe_3Si$ and small particles having a composition of $Fe_3Si$ were used.

Example 10

A dust core was obtained in the same manner as in Example 3 except that large particles having a composition of $Fe_4Si_2Cr$ were used.

Example 11

A dust core was obtained in the same manner as in Example 3 except that large particles having a composition of $FeNi_2Si_3Co$ were used.

Example 12

A dust core was obtained in the same manner as in Example 3 except that the large particles and the small particles were blended at a weight ratio of 9:1.

Example 13

A dust core was obtained in the same manner as in Example 3 except that the large particles and the small particles were blended at a weight ratio of 8:2.

Example 14

A dust core was obtained in the same manner as in Example 3 except that the large particles and the small particles were blended at a weight ratio of 6:4.

Example 15

A dust core was obtained in the same manner as in Example 3 except that the large particles and the small particles were blended at a weight ratio of 5:5.

Comparative Example 1

A dust core was obtained in the same manner as in Example 1 except that particles having an average particle size of 25 μm as large particles and particles having an average particle size of 500 nm as small particles were used. From the SEM image of the cross section of the dust core, the presence of a particle group having an average particle size of 3 μm or more and 15 μm or less cannot be confirmed.

Comparative Example 2

A dust core was obtained in the same manner as in Example 1 except that particles having an average particle size of 10 μm as large particles and particles having an average particle size of 150 nm as small particles were used. From the SEM image of the cross section of the dust core, the presence of a particle group having an average particle size of 300 nm or more and 900 nm or less cannot be confirmed.

Comparative Example 3

A dust core was obtained in the same manner as in Example 1 except that particles having an average particle size of 10 μm as large particles and particles having an average particle size of 1200 nm as small particles were used. From the SEM image of the cross section of the dust core, the presence of a particle group having an average particle size of 300 nm or more and 900 nm or less cannot be confirmed.

Comparative Example 4

A dust core was obtained in the same manner as in Example 3 except that particles having a composition of $Fe_{9.5}Si_{5.5}Al$ were used as small particles.

Comparative Example 5

A dust core was obtained in the same manner as in Example 3 except that particles having a composition of $Fe_{80}Ni$ were used as small particles.

soft magnetic material powder whose saturation magnetic flux density of large particles and small particles is 1.4 T or more and observed in the cross section of the dust core, the DC superimposition characteristics are excellent, and the core loss is low. On the other hand, in the case of using particles having an average particle size of 25 μm as large particles, the core loss increased (Comparative Example 1). In addition, in the case of using particles having an average particle size of 150 nm as small particles (Comparative Example 2) and the case of using particles having an average particle size of 1200 nm as small particles (Comparative

TABLE 1

| | Composition | | Average particle size of material particles | | Blend Large particles:small particles | Saturation magnetic flux density (T) | | Electrical resistance of small |
|---|---|---|---|---|---|---|---|---|
| | Large particles | Small particles | Large particles (μm) | Small particles (nm) | (Weight ratio) | Large particles | Small particles | particles (μΩ · cm) |
| Example 1 | $Fe_{6.5}Si$ | $Fe_{6.5}Si$ | 3 | 300 | 7:3 | 1.8 | 1.8 | 75 |
| Example 2 | $Fe_{6.5}Si$ | $Fe_{6.5}Si$ | 5 | 450 | 7:3 | 1.8 | 1.8 | 75 |
| Example 3 | $Fe_{6.5}Si$ | $Fe_{6.5}Si$ | 10 | 700 | 7:3 | 1.8 | 1.8 | 75 |
| Example 4 | $Fe_{6.5}Si$ | $Fe_{6.5}Si$ | 15 | 900 | 7:3 | 1.8 | 1.8 | 75 |
| Example 5 | $Fe_{6.5}Si$ | $Fe_4Si_2Cr$ | 10 | 700 | 7:3 | 1.8 | 1.6 | 55 |
| Example 6 | $Fe_{6.5}Si$ | $FeNi_2Si_3Co$ | 10 | 700 | 7:3 | 1.8 | 1.4 | 90 |
| Example 7 | $Fe_{6.5}Si$ | Fe | 10 | 700 | 7:3 | 1.8 | 2.1 | 10 |
| Example 8 | $Fe_{4.5}Si$ | $Fe_{4.5}Si$ | 10 | 700 | 7:3 | 1.9 | 1.9 | 55 |
| Example 9 | $Fe_3Si$ | $Fe_3Si$ | 10 | 700 | 7:3 | 2.0 | 2.0 | 40 |
| Example 10 | $Fe_4Si_2Cr$ | $Fe_{6.5}Si$ | 10 | 700 | 7:3 | 1.6 | 1.8 | 75 |
| Example 11 | $FeNi_2Si_3Co$ | $Fe_{6.5}Si$ | 10 | 700 | 7:3 | 1.4 | 1.8 | 75 |
| Example 12 | $Fe_{6.5}Si$ | $Fe_{6.5}Si$ | 10 | 700 | 9:1 | 1.8 | 1.8 | 75 |
| Example 13 | $Fe_{6.5}Si$ | $Fe_{6.5}Si$ | 10 | 700 | 8:2 | 1.8 | 1.8 | 75 |
| Example 14 | $Fe_{6.5}Si$ | $Fe_{6.5}Si$ | 10 | 700 | 6:4 | 1.8 | 1.8 | 75 |
| Example 15 | $Fe_{6.5}Si$ | $Fe_{6.5}Si$ | 10 | 700 | 5:5 | 1.8 | 1.8 | 75 |
| Comparative Example 1 | $Fe_{6.5}Si$ | $Fe_{6.5}Si$ | 25 | 500 | 7:3 | 1.8 | 1.8 | 75 |
| Comparative Example 2 | $Fe_{6.5}Si$ | $Fe_{6.5}Si$ | 10 | 150 | 7:3 | 1.8 | 1.8 | 75 |
| Comparative Example 3 | $Fe_{6.5}Si$ | $Fe_{6.5}Si$ | 10 | 1200 | 7:3 | 1.8 | 1.8 | 75 |
| Comparative Example 4 | $Fe_{6.5}Si$ | $Fe_{9.5}Si_{5.5}Al$ | 10 | 700 | 7:3 | 1.8 | 1.0 | 80 |
| Comparative Example 5 | $Fe_{6.5}Si$ | $Fe_{80}Ni$ | 10 | 700 | 7:3 | 1.8 | 0.7 | 50 |

| | μi (at 3 MHz) | μdc* (at 8000 A/m) | DC superimposition characteristics μdc*/μi | Core loss (kw/m³ at 3 MHz, 10 mT) | Core loss (kw/m³ at 5 MHz, 10 mT) |
|---|---|---|---|---|---|
| Example 1 | 41 | 38 | 0.927 | 195 | 342 |
| Example 2 | 50 | 45 | 0.900 | 180 | 337 |
| Example 3 | 53 | 43 | 0.811 | 268 | 563 |
| Example 4 | 55 | 44 | 0.800 | 393 | 955 |
| Example 5 | 51 | 41 | 0.804 | 307 | 677 |
| Example 6 | 50 | 40 | 0.800 | 236 | 485 |
| Example 7 | 46 | 41 | 0.891 | 403 | 955 |
| Example 8 | 54 | 47 | 0.870 | 337 | 763 |
| Example 9 | 58 | 50 | 0.862 | 363 | 837 |
| Example 10 | 58 | 45 | 0.776 | 328 | 737 |
| Example 11 | 60 | 47 | 0.783 | 234 | 464 |
| Example 12 | 37 | 29 | 0.789 | 330 | 777 |
| Example 13 | 45 | 36 | 0.799 | 299 | 688 |
| Example 14 | 48 | 40 | 0.837 | 237 | 492 |
| Example 15 | 44 | 38 | 0.858 | 206 | 423 |
| Comparative Example 1 | 70 | 29 | 0.414 | 1007 | 2677 |
| Comparative Example 2 | 42 | 29 | 0.690 | 266 | 488 |
| Comparative Example 3 | 35 | 28 | 0.800 | 342 | 820 |
| Comparative Example 4 | 34 | 23 | 0.676 | 281 | 594 |
| Comparative Example 5 | 53 | 25 | 0.472 | 340 | 789 |

From Table 1, as in Examples 1 to 15, in the dust core whose ratio of the area occupied by the large particles to the area occupied by the small particles in the cross section is 9:1 to 5:5 when a group of particles having a particle size of 3 μm or more and 15 μm or less is defined as large particles and a group of particles having a particle size of 300 nm or more and 900 nm or less is defined as small particles in the Example 3), the permeability was reduced. Since the ratio of the area occupied by the large particles having a particle size of 3 μm or more and 15 μm or less to the area occupied by the small particles having a particle size of 300 nm or more and 900 nm or less is out of the range of 9:1 to 5:5 in Comparative Examples 1 to 3, it is considered that the desired DC superimposition characteristics cannot be obtained and the core loss increases. In addition, in the case of using the small particles having a saturation magnetic flux density lower than 1.4 T (Comparative Examples 4 and 5), the DC permeability (μdc) decreases, so that the desired DC superimposition characteristics cannot be obtained.

What is claimed is:

1. A dust core comprising large particles and small particles of insulated soft magnetic material powder, wherein the large particles and the small particles have a saturation magnetic flux density of 1.4 T or more, and wherein in the soft magnetic material powder observed in a cross section of the dust core, a ratio of an area occupied by the large particles to an area occupied by the small particles in the cross section is 9:1 to 5:5, when a group of particles having a particle size of 3 μm or more and 15 μm or less is defined as the large particles, and a group of particles having a particle size of 300 nm or more and 900 nm or less is defined as the small particles, wherein the small particles are alloy powder containing at least Fe and Si, and wherein the small particles have an electrical resistance of 40 μΩ·cm or more.

2. The dust core according to claim 1, wherein the small particles contain one or more elements selected from the group consisting of Ni, Co, and Cr.

3. The dust core according to claim 1, wherein the small particles are comprised of any one of an Fe—Si alloy, an Fe—Si—Cr alloy, and an Fe—Ni—Si—Co alloy.

4. An inductor element, comprising the dust core according to claim 1.

5. A dust core comprising large particles and small particles of insulated soft magnetic material powder, wherein the large particles and the small particles have a saturation magnetic flux density of 1.4 T or more, wherein in the soft magnetic material powder observed in a cross section of the dust core, a ratio of an area occupied by the large particles to an area occupied by the small particles in the cross section is 9:1 to 5:5, when a group of particles having a particle size of 3 μm or more and 15 μm or less is defined as the large particles, and a group of particles having a particle size of 300 nm or more and 900 nm or less is defined as the small particles, and wherein the small particles are alloy powder containing at leas Fe and Si.

6. The dust core according to claim 5, wherein the small particles have an electrical resistance of 60 μΩ·cm or more.

7. The dust core according to claim 5, wherein the small particles contain one or more elements selected from the group consisting of Ni, Co, and Cr.

8. An inductor element, comprising the dust core according to claim 5.

* * * * *